US005263531A

United States Patent [19]

Drury et al.

[11] Patent Number: 5,263,531

[45] Date of Patent: * Nov. 23, 1993

[54] CASTING PROCESS USING LOW MELTING POINT CORE MATERIAL

[75] Inventors: Paul E. Drury, Henderson, Ky.; James M. Evans, Evansville, Ind.; Stephen W. Buckman, Waverly; Roland N. Gibbs, Henderson, both of Ky.

[73] Assignee: Gibbs Die Casting Aluminum Corporation, Henderson, Ky.

[ * ] Notice: The portion of the term of this patent subsequent to May 18, 2010 has been disclaimed.

[21] Appl. No.: 919,834

[22] Filed: Jul. 27, 1992

Related U.S. Application Data

[63] Continuation-in-part of Ser. No. 764,367, Sep. 23, 1991.

[51] Int. Cl.[5] ..... B22D 17/12; B22D 17/14; B22D 27/11; B22D 29/00

[52] U.S. Cl. ..... 164/120; 164/132; 164/113; 164/133

[58] Field of Search ..... 164/345, 132

[56] References Cited

U.S. PATENT DOCUMENTS

| | | | |
|---|---|---|---|
| 1,544,930 | 7/1925 | Pack | 164/132 |
| 1,662,354 | 3/1928 | Williams . | |
| 1,710,534 | 4/1929 | Field | 164/132 |
| 1,777,975 | 10/1930 | Klepsch . | |
| 2,609,576 | 9/1952 | Roush et al. | 22/200 |
| 3,068,539 | 12/1962 | Wilcoxon . | |
| 3,106,002 | 10/1963 | Bauer . | |
| 3,209,416 | 10/1965 | Morton . | |
| 3,258,816 | 7/1966 | Rearwin | 164/132 |
| 3,268,960 | 8/1966 | Morton . | |
| 3,387,646 | 6/1968 | Lauth . | |
| 4,025,361 | 5/1977 | Lucas | 134/28 |
| 4,082,566 | 4/1978 | Arendt et al. | 134/2 |
| 4,088,178 | 5/1978 | Ueno et al. . | |
| 4,380,261 | 4/1983 | Suzuki et al. . | |
| 4,411,709 | 10/1983 | Nakanishi | 148/3 |
| 4,446,907 | 5/1984 | Suzuki et al. . | |
| 4,476,911 | 10/1984 | Lossack et al. . | |
| 4,569,384 | 2/1986 | Mills | 164/131 |
| 4,586,560 | 5/1986 | Ikeya et al. . | |
| 4,712,600 | 12/1987 | Hamajima et al. | 164/132 |
| 4,932,458 | 6/1990 | Iwamoto et al. . | |
| 4,955,426 | 9/1990 | Akimoto et al. . | |
| 5,022,457 | 6/1991 | Iwamoto et al. . | |

FOREIGN PATENT DOCUMENTS

| | | |
|---|---|---|
| 51-99622 | 2/1976 | Japan . |
| 1008610 | 10/1965 | United Kingdom . |
| 2183516A | 6/1987 | United Kingdom . |

OTHER PUBLICATIONS

Squeeze Cast Diesel Pistons M. F. McGuire, Sep. 1979.
Heat Treating of Nonferrous Metals ASM Committee on Heat Treating of Aluminum Alloys, no date.
Development of Medium Pressure Diecasting Process (MP Process) Tokyo Light Metal Mfg. Co., Ltd., no date.

(List continued on next page.)

*Primary Examiner*—Kurt C. Rowan
*Assistant Examiner*—Erik R. Puknys
*Attorney, Agent, or Firm*—Barnes & Thornburg

[57] ABSTRACT

An improved squeeze casting process is utilized to produce metal castings having superior mechanical properties. The process is particularly adapted for use in a vertical casting machine and is characterized by vacuum ladling, vacuum evacuated mold cavities, low metal temperatures, small metal feed gates and high gate velocities, application of high metal pressure on the metal filled cavity through the feed gate, and short processing times. When applied to aluminum alloy casting the squeeze casting process produces metal castings that can be heat treated at high temperatures to improve their mechanical characteristics. The process also allows for production of metal castings having complex internal cavities. The process relies upon the use of complex core pieces demonstrating superior positional and dimensional stability.

20 Claims, 7 Drawing Sheets

OTHER PUBLICATIONS

Squeeze Casting for Disc Brake Calipers SAE Technical Paper Series, Feb. 26-Mar. 2, 1990.

Development of Aluminum Alloy Roller Type Valve Rocker Arm by Casting and Forging Technique SAE Technical Paper Series, Feb. 27-Mar. 3, 1989.

Heat Treating Aluminum American Machinist Special Report No. 635, Oct. 6, 1989.

Problems in Conventional Casting UBE Industries, Ltd., no date.

Development of HVSC and Its Features UBE Industries, Ltd., no date.

Paper No. G-T81-062-Vertical Die Casting Machine for Squeeze Casting UBE Industries, Ltd., Jun. 1-4, 1981.

Weingarten flyer no date.

Die Casting Machines Japanese Abstract WO 80/01655, Aug. 21, 1980.

Die-Casting Method and Apparatus Japanese Abstract WO 80/01656, Aug. 21, 1980.

Die Casting Method Japanese Abstract WO 80/01657, Aug. 21, 1980.

Die Casting Method Japanese Abstract WO 80/01658, Aug. 21, 1980.

Paper No. G-T77-011-The Influence of Injection Cycle on Casting Quality Part 1-The Effect of Shot Velocity and Timing on Die Venting and Casting Porosity CSIRO-University of Melbourne, Jun. 6-9, 1977.

Paper No. G-T77-012-The Influence of Injection Cycle on Casting Quality Part II-The Effect of First Stage Conditions on Cavity Fill and Casting Porosity CSIRO-University of Melbourne, Jun. 1-9, 1977.

Paper No. G-T83-061-Development and Application of Vertical Pressure Die Casting Process Toyota Motor Corporation, Oct. 31-Nov. 3, 1983.

Paper No. 84-Application of Vacuum in Die Casting for Quality Improvement Westinghouse Electric Corp., Nov. 16-19, 1970.

Paper No. 1272-Vertical Die Casting Machines Kent A. Mulholland, Oct. 16-19, 1972.

Paper No. 86-Squeeze Casting I.I.T. Research Institute, Nov. 16-19, 1970.

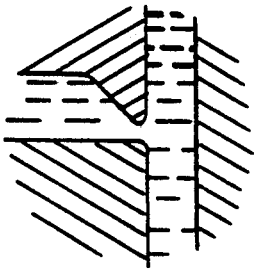
FIG. 3a
FIG. 3b
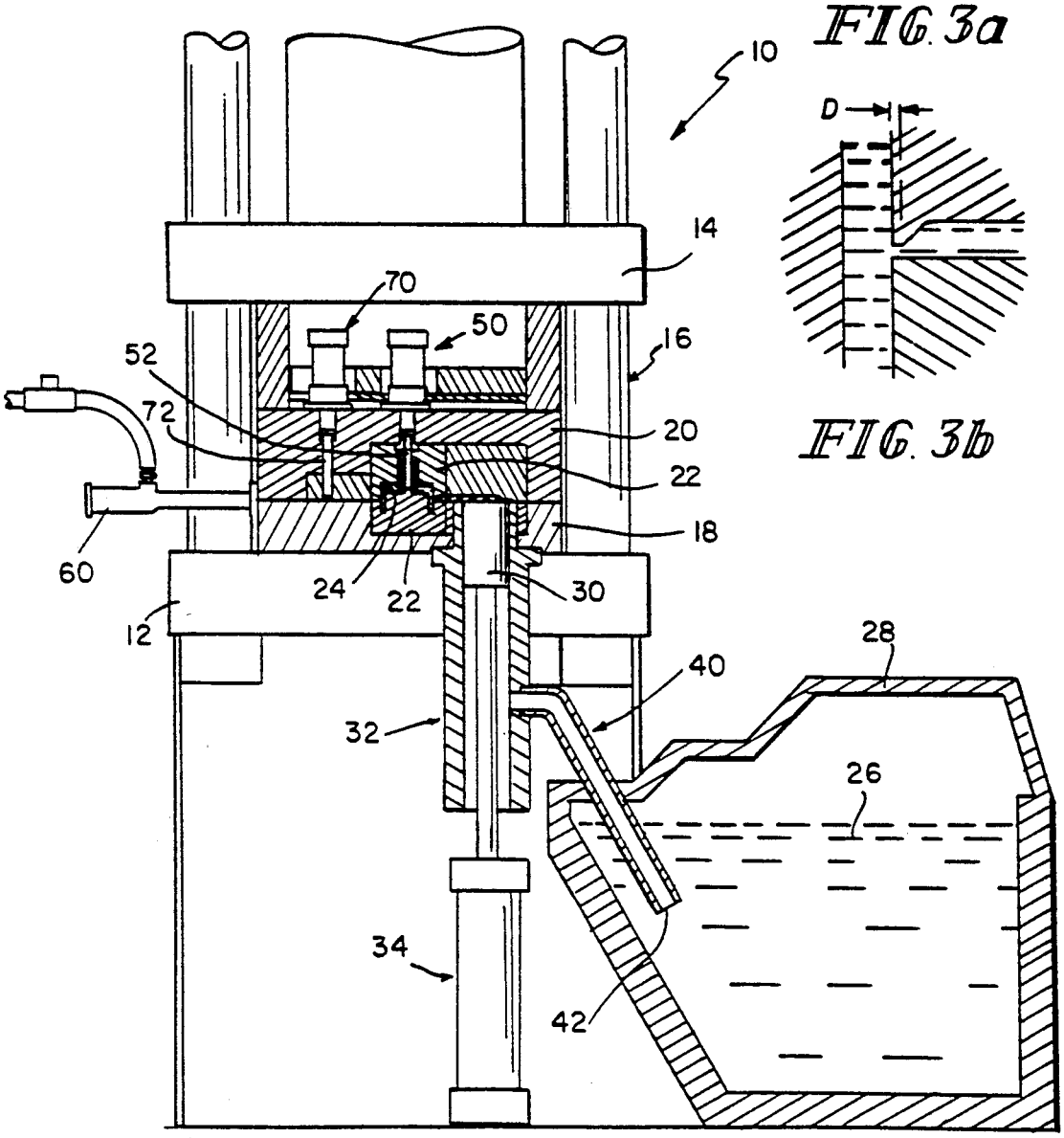
FIG. 3

FREE FALL
LOCK UP
VACUUM LADLE
SHOT
INTENSIFIER
DWELL
DECOMPRESS
DIE OPEN
UNLOADER IN
EJECT
UNLOADER OUT
SPRAY
1.6
3.1
4.7
VOLUME OF DIE FILLED
5.2
15.2
15.7
17.7
19.0
19.5
21.0
29.0
0
5
10
15
20
25
30
TIME IN SECONDS

CASTING PROCESS USING LOW MELTING POINT CORE MATERIAL

Cross-Reference to Related Application

This application is a continuation-in-part of U.S. application Ser. No. 07/764,367, filed Sep. 23, 1991, copending.

BACKGROUND AND SUMMARY OF THE INVENTION

The present invention relates to casting processes, and more particularly to the provision of a high pressure die-casting process which produces extremely fine-grained, dense castings with integrity competitive with forging and other more expensive casting processes and with complex core shapes not attainable with conventional die-casting processes. In specific, the present invention may be referred to as an improved squeeze casting or squeeze die-casting process in which pressures as high as 12,000 to 20,000 psi or even higher are applied with the shot plunger or plunger to force metal into the die-casting mold cavity to surround a complex core made from metal that can be melted out of the casting after it is formed. The process can be used to produce heat-treatable aluminum alloy castings having cores not heretofore attainable.

Die-casting processes are very well known. The improved die-casting process of the present invention makes use of a novel combination of conventional die-casting process features and machines which are well known in the industry, but which need to be described in detail herein to provide the necessary background. To these well known process features and machines, the present invention adds inventive control features, process controls and core producing processes to get the markedly improved die-cast metal results. It is believed that no one heretofore has provided such a novel combination of process features and process controls and that no one has heretofore achieved such good casting structural integrity, particularly with complex cores, using low cost, high speed and volume die-casting techniques.

In conventional die-casting, a metal mold system having at least two parts forms a mold cavity into which molten metal is forced by pressure action of a shot plunger to fill the cavity where the metal is solidified to take the shape of the cavity. The advantages of such die-casting are well known, particularly as they relate to high volume production and low cost. The disadvantages of die-casting are also well known in that conventional die-cast parts are known to have structural limitations, high porosity, etc. For instance, heretofore, it has been impossible to obtain die-cast parts having complex core shapes and also having high strength, low porosity, etc. Even the best die-casting processes, before the present invention, produced metal parts with some porosity and other structural integrity property problems. Aluminum alloy parts produced by such processes are typically not suitable for heat treatment using high temperatures.

In this specification, and in the appended claims, the following terms and their definitions shall apply unless specifically indicated otherwise:

Die-casting: A process involving the forcing of molten metal from a shot sleeve into a mold cavity formed in and by metal dies to have the metal solidify in the cavity to take its shape.

Squeeze Die-casting: A process of die-casting involving the forcing of molten metal into the mold cavity under extremely high pressures in the range of about 10,000 to about 20,000 psi or even higher with the shot sleeve plunger which feeds the metal. This high pressure is applied while the metal is still molten at least in the metal feed gate which connects the cavity to the shot sleeve.

Vacuum Die-Casting: The process of drawing a vacuum on the mold cavity and the passageways (runner system including the shot sleeve and transfer tube to the furnace) through which the molten metal is fed to remove air which might otherwise be trapped by the molten metal.

Vacuum Ladling: The process of using the vacuum system which evacuates the cavity and the runner system also to draw the molten metal into the shot sleeve to be driven by the plunger which feeds the metal into the mold cavity.

Small Feed Gates: The gates through which the molten metal is driven into the mold cavity are said to be small gates when they have a cross-sectional area less than about 0.2 in.$^2$, more typically less than about 0.15 in.$^2$. For instance, small feed gates may be 1 in. wide and 0.060 in. to 0.125 in. tall, perhaps only 0.75 in. wide or a gate which is circular in cross-section with a diameter of about 0.125 in. to 0.175 in., in other words, gates typically used in conventional die-casting.

Large Feed Gate: In contrast, a large feed gate is a gate which has a cross-sectional area greater than about 0.25 in.$^2$; for example, it may be 1 in. wide and 0.60 in. tall.

Vacuum Gate: The very small gate through which the vacuum is drawn leading from the cavity. It typically has a cross-sectional area of less than 0.1 in.$^2$ and may be, for instance, about 0.500 in. wide and about 0.030 in. to 0.060 in. tall.

Slow Gate Velocity: The flow of molten metal through a feed gate is said to be slow when the velocity is about 0.1 ft. per second up to about 20 or 25 feet per second.

High Gate Velocity: The velocity of the molten metal through the feed gate is said to be high when the velocity is in ranges from about 40 ft. per second to about 150 ft. per second or even higher.

Shot Sleeve: The sleeve or cylinder into which the molten metal is drawn or vacuum ladled from the furnace to be driven by the shot plunger through the feed gate into the mold cavity. The shot sleeve is connected by a transfer tube to the molten metal in the furnace. In some cases, the shot sleeve is referred to as an "injection cylinder."

Intensification Pins: The pins used to intensify the pressure on the molten metal in the mold cavity after the small feed gate into the cavity is frozen (metal solidified) but before the thicker sections are frozen. The intensification pins are driven into the mold cavity space to apply extremely high localized pressures in the thicker sections penetrated by the pins.

Gravity Casting: Is a casting process in which the molten metal is poured into mold cavities and includes lost foam casting, permanent mold casting, sand casting, and lost wax casting processes. Certain aluminum alloys have been cast primarily in permanent mold castings in the past to produce high quality parts, but can now be die-cast in accordance with the process of the present invention and subsequently heat treated with a high temperature. One such aluminum alloy is a 390 aluminum alloy which has a high silicon content.

Forging: Is a process using high heat and high impact blows to force a piece of metal into a particular shape to produce a high quality part. Forging and gravity casting are discussed herein to provide a comparison basis with which the low cost, high volume die-cast parts made in accordance with the present invention compete favorably.

T-6 Heat Treating: Is a well known heat treating process widely used to heat treat aluminum alloy castings made in the permanent mold casting process or forging processes. It is conventional thinking in the aluminum die-casting industry that aluminum parts made by conventional die-casting cannot be heat treated in accordance with T-6 heat treating processes. The process involves holding the parts at high temperatures of 920° F. to 925° F. for long periods of time, typically up to about 12 hours, followed by a water quench and after 24 hours a second heat treatment at about 350° F. for about 8 hours. It is believed that this T-6 heat treating process causes the copper and magnesium to go back into solution to make the microstructure harder and stronger and also to make the silicon particles less needle-like. The industry accepts that conventional die-casting parts cannot be heat treated with the T-6 heat treating process because of the porosity which will produce blisters.

Cool Water Quench: Is a quenching process involved in the T-6 heat treating process which normally uses water held at about 200° F. Cool water quenching involves quenching in water held at, for instance, 100° F. to 120° F. within a short period of time of, for instance, ten seconds or so after the part is removed from the furnace where it is held at 920° F. to 925° F.

VERTI-CAST Machines: Are the die-cast machines known in the trade for their vertical orientation, particularly an orientation in which the upper and lower molds are carried, respectively, on upper and lower platens to provide a plurality of mold cavities peripherally spaced about a vertical center axis with a vertically arranged shot sleeve and injection plunger for forcing the molten metal upwardly into the concentrically arranged mold cavities.

High Temperature Metal: Is metal held in a die-casting furnace at a temperature well above the temperature at which the metal starts to solidify, perhaps as much as 200° F. or more above that temperature, and injected into the mold cavity at the high temperature. For example, 390 aluminum alloy has a freezing point of 945° F., and it begins to solidify at 1,200° F. Thus, high temperature 390 aluminum alloy would be held at a temperature of about 1,400° F. or above.

Low Temperature Metal: Is metal held in a die-casting furnace at temperatures not more than about 100° F. above the temperature at which the metal starts to solidify and typically not more than about 15° F. to about 50° F., above the temperature at which the metal starts to solidify, and injected into the mold cavity at the low temperature. The temperature difference between the freezing point of a metal and the point at which the metal starts to solidify is dependent on metal alloy composition. Generally it ranges from as little as about 15° up to about 250° F. in aluminum alloys.

Complex Core: A complex core is a core having a geometry that complicates the process of separating the core piece from the die-cast part. In die-casting, it is common to put a slightly tapered protrusion on a die to form an opening or bore in the casting. Because the protrusion is tapered, when the dies are separated, the solid cast part will pull off the tapered protrusion. By contrast, a complex core may, for instance, be larger as it progresses into the mold cavity, such that the core piece cannot be removed readily from the die-cast part.

Core Piece: The process of the present invention contemplates placing a core piece inside the mold cavity to be held securely in position by the metal dies when they close. The molten metal is forced into the mold cavity to fill the cavity and surround the core piece. When the dies are separated, and the casting is removed, the core piece is, of course, trapped by the cast metal. In the process of the present invention, this core piece is melted out of the cast piece to produce the desired complex core shape.

Low Melting Point Core Metal: Core metals which will melt at about 150°–400° F., or even as high as about 700° F., are referred to herein as "low melting point core metals" to distinguish them from high melting point core metals used in accordance with the present invention. For example, a metal known as "Wood's Metal," which melts at about 158° F., would be characterized as a low melting point core metal for purposes of the present invention.

High Melting Point Core Metal: Some metals, such as pure zinc and various zinc alloys, have a melting point that is relatively higher, for instance, in the range of about 700° F. to about 850° F., or even as high as about 925° F. Temperatures at the upper end of this range approach the high temperatures of T-6 heat treating. In accordance with the present invention, high melting point core metals are metals that will melt at temperatures greater than 700° F., and possibly even temperatures approaching the T-6 heat treating temperatures to flow out of the castings to leave a complex core. A core piece made from such high melting point core metal will survive the die-casting metal injection process of the present invention and be removable by subsequent heating to a temperature that would cause blistering and other problems with conventional die-cast parts.

Frozen Core Piece: It has been found that, even with high melting point core metals such as zinc or zinc alloys, the dimensional and positioning stability of the core pieces in the mold cavities can be enhanced by chilling or even freezing the pieces before they are placed in the mold cavities. For instance, core pieces may be soaked in liquid nitrogen to reduce their temperature to a point where they will be very stable in the necessarily hot mold cavity for a period of time sufficient to close the mold, inject the metal under pressure, and let the injected metal solidify around the core piece.

It is known to accomplish squeeze die-casting of aluminum alloy using large metal feed gates, slow gate velocities, high temperatures and squeeze pressures by the shot plunger in the range of 10,000 to 20,000 psi on the metal. These squeeze die-castings are reported to use molten metal at a high temperature, for example, in the range of 1,460° F., low gate velocities with the large metal feed gates. The metal being injected at 1,460° F., which is approximately 200° F. above the point at which the metal begins to solidify, takes much longer to chill and the squeeze pressure is applied over a much longer period of time because, generally speaking, the metal in the large feed gate is typically the last section on the whole casting to freeze. The squeeze pressure pushes molten metal into the cavity as the metal cools and shrinks. One problem is that the high temperature of 1,460° F. requires exceptionally long chilling periods and consequent slower production rates. The high temperature metal also wears the molds.

In squeeze die-casting in accordance with the present invention, the metal is injected at a low metal temperature—about 1,260° F. or, perhaps, 1,270° F.±20° F. for a 390 alloy aluminum. The molten metal is vacuum ladled from the center of the mass of molten metal quickly into the shot sleeve and very quickly driven at high pressure through the small feed gates into the mold cavity. Because the combination of low metal temperature and small feed gates results in faster feed gate freezing, the squeeze pressure is applied over a very short period of time.

There are many examples in the prior art of conventional die-casting processes which have included some or even most of the process steps, features and controls of the present invention. For example, it is known to have conventional die-casting with vacuum evacuation, vacuum ladling, small feed gates, small vacuum gates and high gate velocities without the squeeze pressures of, for instance, 10,000 to 20,000 psi. It is known that some Japanese die-casters use such conventional die-casting processes, even involving squeeze die-casting high pressures on the shot plunger, with small feed gates and high gate velocities, but without using vacuum evacuation and vacuum ladling which is a prominent feature of the combination of steps of the present invention. Such conventional die-casting in Japan, even using squeeze die-casting plunger pressures, have been reported not to be heat treatable in accordance with the T-6 heat treating processes. In fact, in order to accomplish T-6 heat treating, the Japanese die-casters reported having to switch to the above-described squeeze die-casting process involving use of large metal feed gates, relatively slow gate velocities, extremely high temperatures and squeeze pressures by the shot plunger.

While many or even most of the process steps and features of the present invention are known in the die-cast industry and, in fact, widely used, no one heretofore has used the claimed combination of process steps and features of the present invention to obtain such remarkably good results in a die-casting machine environment using low temperature metal for the molten metal which is ideally suited for high volume production. Die-cast parts made in accordance with the present invention have been compared, for instance, to similar parts made by forging, and found to be remarkably superior to the forged parts in deformation characteristics. While the squeeze die-cast parts produced in accordance with the die-cast process of the present invention are significantly improved, it has been found that they can be even more significantly improved using the T-6 heat treating process which conventional knowledge says is not applicable to die-cast aluminum parts.

The squeeze die-casting process of the present invention may preferably be carried out on what is known in the trade as a VERTI-CAST machine to be described hereinafter. However, it is believed that the process can be carried out with equal efficiency on horizontal casting machines that have been modified for vacuum die evacuation ladling. In vertical casting machines, modified in accordance with the present invention, low temperature metal is drawn by vacuum (vacuum ladled) from the adjacent furnace through the transfer sleeve into the vertically extending shot sleeve to be driven by the vertically upwardly driven plunger to feed the mold cavities through the metal feed gates and runner system arranged concentrically about the center of the shot sleeve. The low temperature metal is driven under pressure applied by the plunger at high velocity through a small feed gate into the evacuated mold cavities. After the mold cavities are filled, the plunger is used to apply high pressure to the metal as it begins to freeze in the mold cavities. The low temperature metal freezes relatively quickly in the small feed gate.

Consistent metal alloy composition is important to optimum performance of the present process, just as it is with other casting processes known in the art. Preferably the molten metal in the furnace is cleaned and degassed using well known industry techniques and the metal temperature is carefully controlled as indicated above. The objective is to have very clean and gas-free metal of consistent alloy composition.

In accordance with the present invention, the entire process of drawing a vacuum on the mold cavities, the feed gate and runner system, the shot sleeve and the transfer tube to suck the molten metal upwardly through the transfer tube into the shot sleeve, the actuation of the plunger to drive the molten metal upwardly into the mold cavities, and the application of the high pressure or squeeze pressure by the plunger and to permit the metal to solidify during a dwell time before the die opens and the part is ejected onto a shuttle tray takes a very short period of time in accordance with the present invention. For instance, the vacuum ladling step may have an effective duration of approximately 1.6 seconds in a typical operation in accordance with the present invention while the shot time or the time it takes for the plunger to drive the molten metal from the shot sleeve into the mold cavities may take only 0.5 seconds duration in a typical application in accordance with the present invention. The squeeze pressure may occur, for instance, only 0.003 seconds before the shot is completed or the mold cavities are filled, and the squeeze pressure may take place over the dwell time, for instance, of 10 seconds. It will be seen that, in a typical application in accordance with the present invention, the molten metal may be ladled upwardly by the vacuum and shot into the mold cavities in about 2.0 to 2.3 seconds, which is extremely fast. Of course, the squeeze pressure can be released after metal freezes in the small feed gate.

As this description progresses, it will be appreciated that the squeeze die-casting process of the present invention is carried out at the relatively low temperatures normally associated with conventional die-casting and not at the high temperatures normally associated with squeeze casting. Since the molten metal is maintained in the furnace in accordance with the present invention at a point just above the point where solidification will begin, the rapid vacuum ladling and rapid plunger injection of the molten metal into the mold cavities is required to fill the mold cavities with still molten metal which can be acted upon by the squeeze pressures applied by the plunger as the metal solidifies. Of course, when the metal solidifies and closes or freezes the metal feed gates, further plunger pressure, no matter how high it is, will have no effect on the metal in the mold cavities. It should also be noted that when the molten metal first enters the mold cavities, it will begin to exit through the above-described vacuum gates which are quite small and exit out into the vacuum runner where the metal will quickly be solidified to block further exit of the metal through the vacuum gate.

Thus, in accordance with the present invention, in about two seconds or even less in some cases, the desired amount of molten metal is vacuum ladled or drawn from the center of the melt of the furnace, through the transfer tube, and into the shot sleeve where the first movement upwardly of the shot plunger shuts off the metal flow from the transfer tube, controlling the amount of metal ladled. The upward movement of the plunger, which may take place over about 0.5 seconds, pushes the low temperature metal into air and gas-free mold cavities to quickly fill the cavities, and then high squeeze pressure is immediately brought to bear on the freezing metal. It will be appreciated that, in accordance with the present invention, all of the various actions of the die-cast machine may be controlled by dwell timers of conventional variety to cause the process steps to occur in a rapid and timely manner. For instance, the shot speed or speed of the drive plunger may be, for instance, 5 ft. per second to obtain a gate feed velocity of 100 ft. per second with a mold cavity fill time of less than about 0.5 second, for example, about 0.15 second.

It is an object of the present invention, therefore, to provide a process for casting aluminum alloy metal in a die-casting apparatus of the type comprising at least a pair of dies forming at least one cavity therebetween having a vacuum gate and a metal feed gate and a runner communicating with the metal feed gate for delivery of molten metal into the cavity, a source of molten metal, a charge sleeve or shot sleeve communicating with said runner for receiving molten metal from the source and directing it through the runner to the feed gate into the cavity, the feed gate controlling the flow of metal from the runner into the cavity, a plunger reciprocally disposed in the sleeve and means for applying pressure to the plunger to force the molten metal under pressure through the runner and metal feed gate into the cavity, and a vacuum source and means for connecting the vacuum source to the vacuum gate, cavity, runner and shot sleeve to remove gases therefrom and to ladle or draw the molten metal from its source into the sleeve in a position to be driven by the plunger. In this equipment just described, the process of the present invention comprises the steps of controlling the plunger as it drives molten metal through the metal feed gate to control the gate velocity into the cavity initially to fill the cavity, dimensioning the metal feed gate to provide a high velocity feed from about 40 ft. per second to about 150 ft. per second into the mold cavity during the initial cavity filling step, and just before, or just as, the cavity is filled, increasing the pressure on the metal up to about 10,000 to 20,000 psi using the shot plunger to force additional molten metal through the feed gate during the pressure increasing step and during the very rapid freezing of the low temperature metal in the mold cavity. The metal in the gate solidifies after the pressure increasing step, but preferably not before the substantial freezing of the metal in the cavity.

Another object of the present invention is to provide such a process for die-casting heat treatable aluminum alloy and subsequently subjecting the die-cast part to heat treating in accordance with T-6 heat treatment procedures. It has been found that a squeeze die-cast part made in accordance with the process of the present invention and heat treated in accordance with T-6 heat treating processes will take a 390 aluminum alloy from its known conventional yield strength of 35,000 psi to a remarkably high 51,000 psi. In a specific comparison test, a normal 390 aluminum alloy ASTM test bar has a standard 35,000 psi yield strength. A similar die-cast ASTM test bar made in accordance with the squeeze die-casting process of the present invention and subjected to T-6 heat treating produced such remarkably good yield strength results. As indicated above, the industry has not been able to heat treat aluminum die-cast aluminum parts in accordance with T-6 heat treating processes before the present invention.

It is, therefore, still another object of the present invention to provide a novel combination of process steps for making a squeeze die-cast part from heat treatable aluminum alloy and then to heat treat that aluminum part in accordance with T-6 heat treating process steps.

While such improved castings may possibly be further improved with intensification pins or squeeze pins as they are known, such remarkably good results are being obtained with the process of the present invention, and the intensification pins may not be required in some cases.

A further object of the present invention is to provide such process steps in a rapid and timely manner using relatively cool, for squeeze die-cast temperatures, molten metal which quickly solidifies after it is injected into the mold.

It is still another object of the present invention to provide such a squeeze die-cast process for casting aluminum alloy metal wherein a cavity of volume $V_c$ in a mold having a vacuum gate and a metal feed gate communicating with the cavity is first evacuated by applying a vacuum to the vacuum gate and thereafter filled through the feed gate with molten metal under pressure $P_1$ at a low metal temperature T above the temperature $T_g$ where the metal begins to solidify. $P_1$ is selected to achieve a high gate velocity. In this environment, the improvement comprises the steps of increasing the pressure of the metal flowing through the metal feed gate to pressure $P_2$ about when the volume of the metal filled into the cavity is about $V_c$, the goal being to continue to force the low temperature molten metal through the feed gate during the very short period of time over which the low temperature metal freezes on the mold. In this recited process, the vacuum accomplishes the vacuum ladling of the molten aluminum alloy metal into the shot sleeve directly from or near the center of mass of molten metal in the furnace. The vacuum ladling and the plunger feeding of metal through the feed gates occurs very rapidly as discussed above. The dimensioning of the feed gate is such that, as the pressure of the low temperature metal is increased from $P_1$ to $P_2$, and concomitantly during the rapid freezing of the metal in the mold, the velocity of the molten metal through the gate is such that the temperature of the metal in the gate is greater than $T_f$, the temperature at which the metal freezes, and the velocity of the metal in the gate at a point in time after $P_2$ is reached is such that the temperature of the metal in the feed gate is less than or equal to $T_f$ whereby the cavity containing pressurized metal is sealed by metal freezing in the feed gate. In this process, the pressure increase to $P_2$ is typically effected by timer actuation to drive more molten metal through the feed gate, of course, at a much slower gate velocity after the volume of metal injected into the mold equals $V_c$. Ideally, the flow of metal through the small feed gate is not interrupted until the temperature of the metal in the mold at $P_2$ is $\leqq T_f$. Molten aluminum alloys can begin to solidify at temperatures, $T_g$, ranging from about 1,080° to about 1,200° F. while metal freezing temperatures, $T_f$, range from about 945° to about 1,065° F., depending on alloy composition.

It is yet a further object of the invention to provide a process for manufacturing molded metal castings in a die-casting apparatus of the type heretofore described, the molded metal castings being formed to include complex internal core shapes. The process comprises the steps of placing a core piece between the pair of dies, drawing the vacuum to ladle the molten metal into the sleeve in an amount of time to prevent the molten metal from appreciably solidifying, controlling the plunger as it drives molten metal through the metal feed gate to control the gate velocity into the cavity initially to fill the cavity, increasing the pressure on the metal up to about 10,000 to 20,000 psi to force additional molten metal through the feed gate, controlling the temperature of the molten metal at less than about 100° F. above the temperature at which the metal begins to solidify, selecting the metal feed gate to have a cross-sectional area such that with the plunger actuation molten metal is fed at a velocity of about 40 to about 150 feet per second into the cavity, removing the resulting casting from the cavity, and melting the core piece out of the resulting casting. The core piece is formed from high melting point core metal that will melt at temperatures from above 700° F. to about 925° F. The core piece provides a complex core shape, and thus the casting resulting from the present process includes a complex core shape therein.

Yet a further object of the invention is to provide a process as described above, further comprising the step of chilling the core piece to a temperature sufficiently low to enhance the positional and dimensional stability of the core piece in the cavity.

Other objects and features of the present invention will become apparent as this description progresses.

BRIEF DESCRIPTION OF THE DRAWINGS

The detailed description particularly refers to the accompanying figures in which:

FIG. 3 is a sectional view similar to FIG. 1 showing the movement of the plunger upwardly to drive the molten metal into the mold cavity;

FIG. 3*a* shows a typical feed gate cross-section;

FIG. 3*b* shows a typical vacuum gate cross-section;

Figure 1:
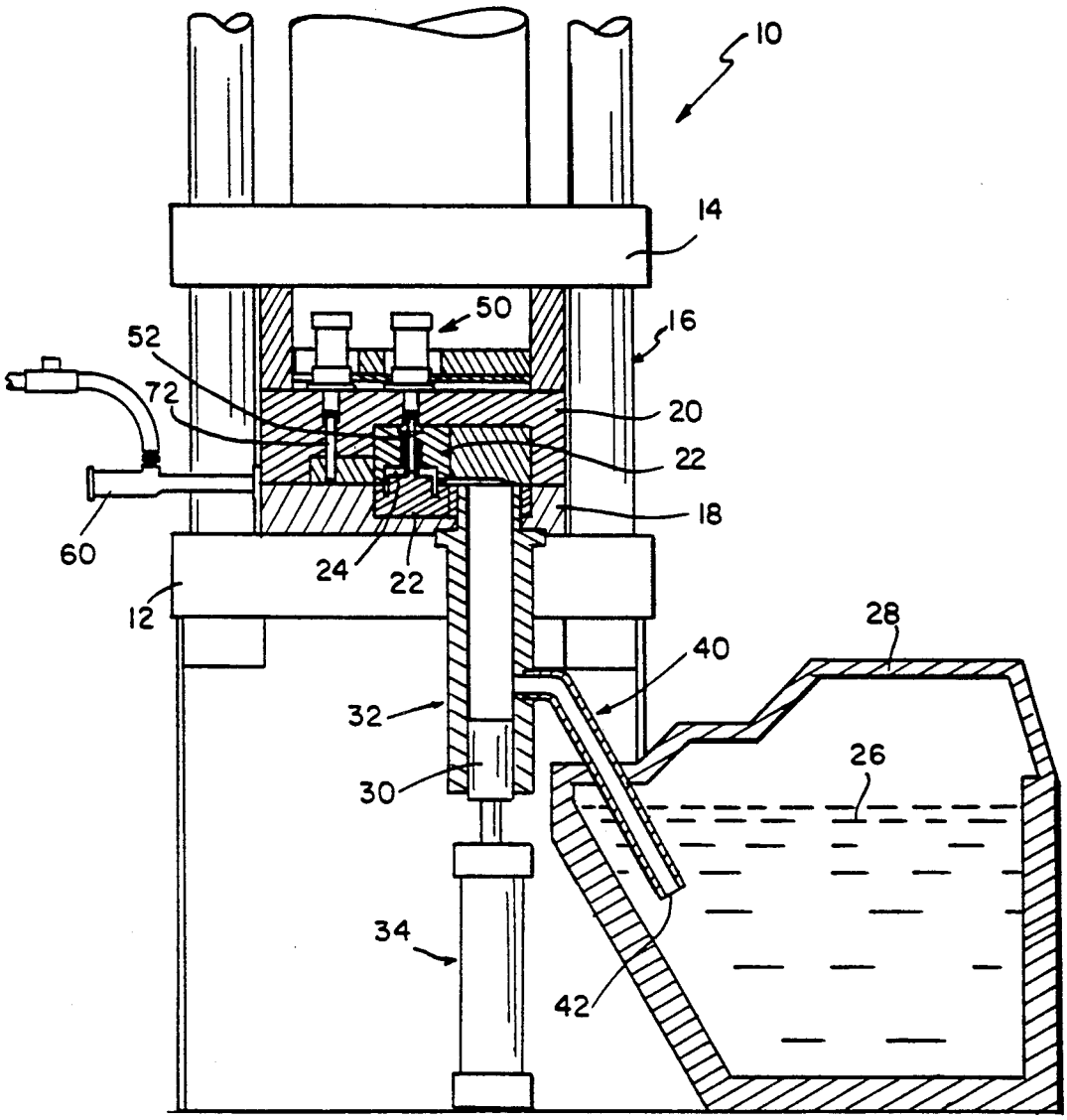
FIG. 1 is a sectional view of a VERTI-CAST machine arranged in accordance with the present invention showing the holding furnace next to the machine, and also showing the status of the machine when the upper platen is in its lower position against the lower, stationary platen to start the die-cast process.

Referring specifically to FIG. 1, it will be seen that the VERTI-CAST machine 10 comprises a lower, stationary platen 12 below a vertically movable platen 14 with a set of die parts 16 disposed between the platens. The die parts 16, in many respects, are conventional and comprise a cover die half 18 on the stationary platen 12, an ejector die half 20 attached to the movable platen 14 with cavity blocks 22 carried by the die halves 18, 20 in a known and conventional manner to define at least one mold cavity 24. It is this at least one mold cavity 24 into which low temperature metal 26 from the furnace 28 is to be injected by the shot plunger 30 operable in the shot sleeve 32 and driven by a hydraulic cylinder 34 capable of maintaining a high pressure on the low temperature metal 26 as it is injected into the mold and further capable of applying a higher pressure on the metal in the filled mold cavity. The shot sleeve 32 is connected by a transfer tube 40 to a point 42 well down into the mass of molten aluminum in the furnace 28.

Figure 2:
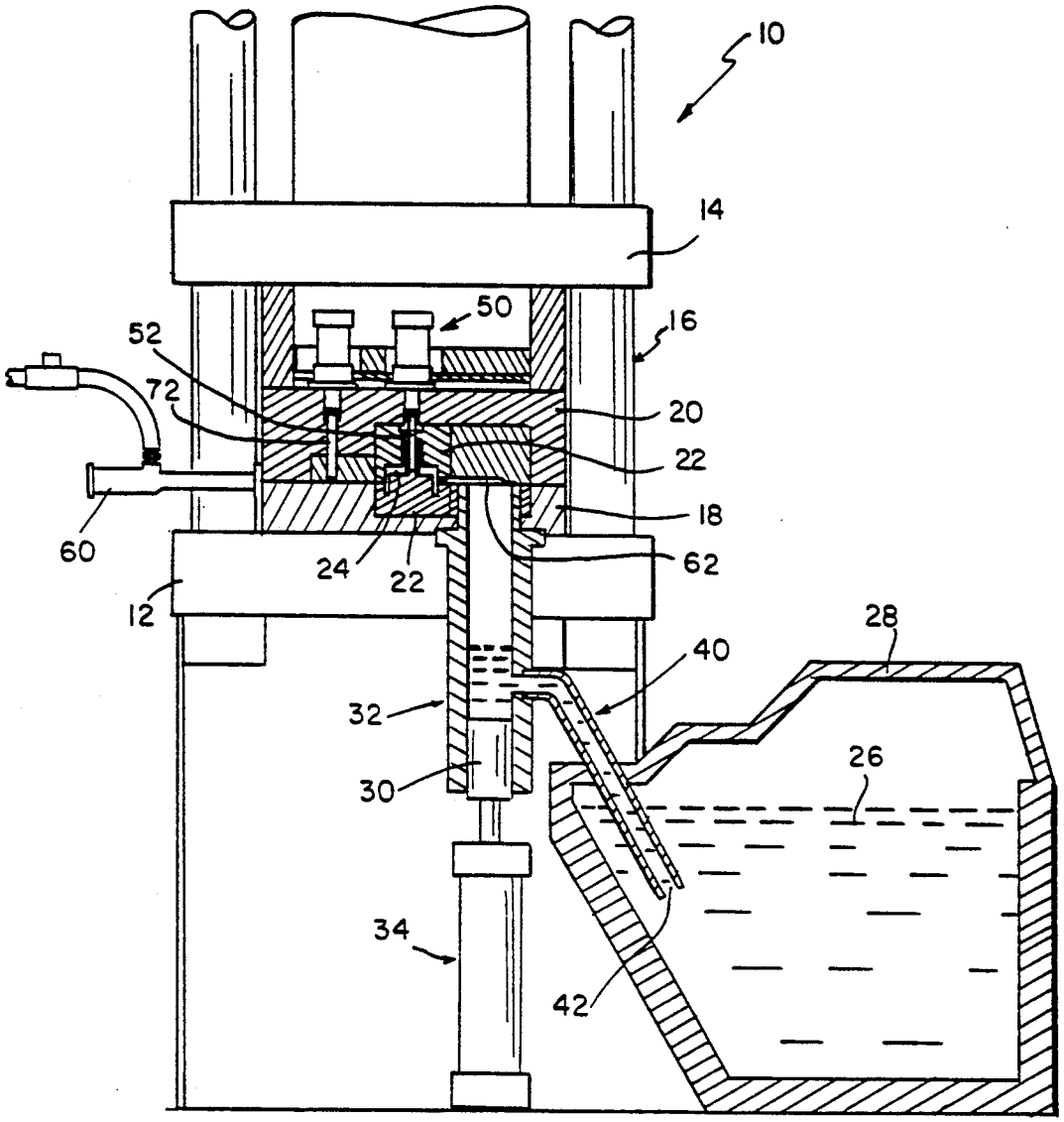
FIG. 2 is a sectional view similar to FIG. 1 and showing what happens during the vacuum application and vacuum ladling phase of the process, particularly the drawing of the molten metal upwardly into the shot sleeve through the transfer tube.

FIG. 1 also illustrates an intensification cylinder 50 for driving an intensification pin 52 into the mold cavity 24 for reasons discussed hereinabove. Depending upon the size of the mold cavity, one or more intensification pins may be driven into the mass of molten metal at extremely high pressures after the metal feed gate is frozen further to intensify the pressure on the metal as it solidifies at locations surrounding the protruding intensification pin. FIG. 1 also shows a vacuum port line 60 connected to the mold cavity 24 through the die halves, 18, 20 in conventional fashion so that the cavity 24, the shot sleeve 32 and the transfer tube 40 may be evacuated. When this happens, the atmospheric pressure acting on the mass of molten metal 26 in the furnace 28 will drive the molten metal upwardly through the transfer tube 40 into the shot sleeve 32 as best seen in FIG. 2. Particularly, evacuation of air and gases from the sleeve 32, runner system 62 and mold cavity 24 is started by a pressure switch indicating that the seal is effective or that, in fact, the die halves 18, 20 are fully closed to provide a seal. This suction action of the vacuum creates a vacuum in the mold cavity 24, runner system 62 (FIG. 2) and shot sleeve 32 to draw the molten aluminum into the sleeve via the transfer tube 40 in about 1–3 seconds. As indicated above, these steps may be timer controlled.

It will be appreciated, as this description progresses, that the action of the plunger 30 in moving the molten metal upwardly through the runner system 62 into the mold cavity 24 must occur rather rapidly because the suction action will actually start drawing the molten metal upwardly into the cavity where the metal will begin to solidify. In other words, the vacuum ladling activity must be very quickly followed by the shot plunger 30 movement upwardly in the shot sleeve 32 because the molten metal will begin to solidify as soon as it leaves the furnace 28.

Turning to FIG. 3, it will be seen that the first movement upwardly of the plunger 30 shuts off the metal flow from the transfer tube 40, controlling the amount of metal ladled into the sleeve 32. Ideal gate size and metal velocity through the gate are determined through various quality studies. Vacuum is shut off by the vacuum shut-off cylinder 70 driving shut-off pin 72 or by use of a chill block (not shown) in the vacuum runner. The vacuum valve cylinder 70 may be closed shortly before the die opens. It will be appreciated that the action of the shot plunger 30, which is rather quick in starting after the ladling and rather rapid, drives the low temperature metal through the runner system 62 into the mold cavity 24 out through the vacuum gate into the vacuum runner formed by the die halves 18, 20. When that stream of molten metal reaches the shut-off pin 72 or the chill block, the vacuum is terminated by the freezing metal.

FIGS. 3*a* and 3*b* illustrate typical metal feed gates and vacuum gates, respectively, for use in accordance with the present invention with the metal feed gate having, for instance, a height of 0.060 in. and a width (into the paper) of, perhaps, 0.75 in. or even 0.100 in. FIG. 3*a*, therefore, illustrates a small metal feed gate. FIG. 3*b* illustrates an even smaller vacuum gate with a thickness or height of 0.045 in. and a width (into the paper) of, perhaps, 0.750 in. to 0.100 in. In die-casting, a metal feed gate or a vacuum gate are relatively small openings from runner system 62 directly into the mold cavity 24. Preferably the gate land (dimension D) is about 0.030 in. While the runner system 62 may provide substantial width, it has been found that reducing the runner system in size to define a small metal feed gate is very attractive for several reasons. Not only does it provide the relatively high metal feed gate velocity which is attractive in accordance with the present invention, but it also provides but a relatively small and frail gate section which needs to be broken or cut away from the cast part.

It is believed that, in accordance with the present invention, the molten metal under the plunger-applied pressure moves through the feed gate at such high velocity that the molten metal actually sprays into the mold cavity 24 to fill the cavity. This spraying action into the vacuum evacuated cavity 24 is believed to contribute to the good structural integrity and lack of porosity produced by the present invention.

Figure 4:
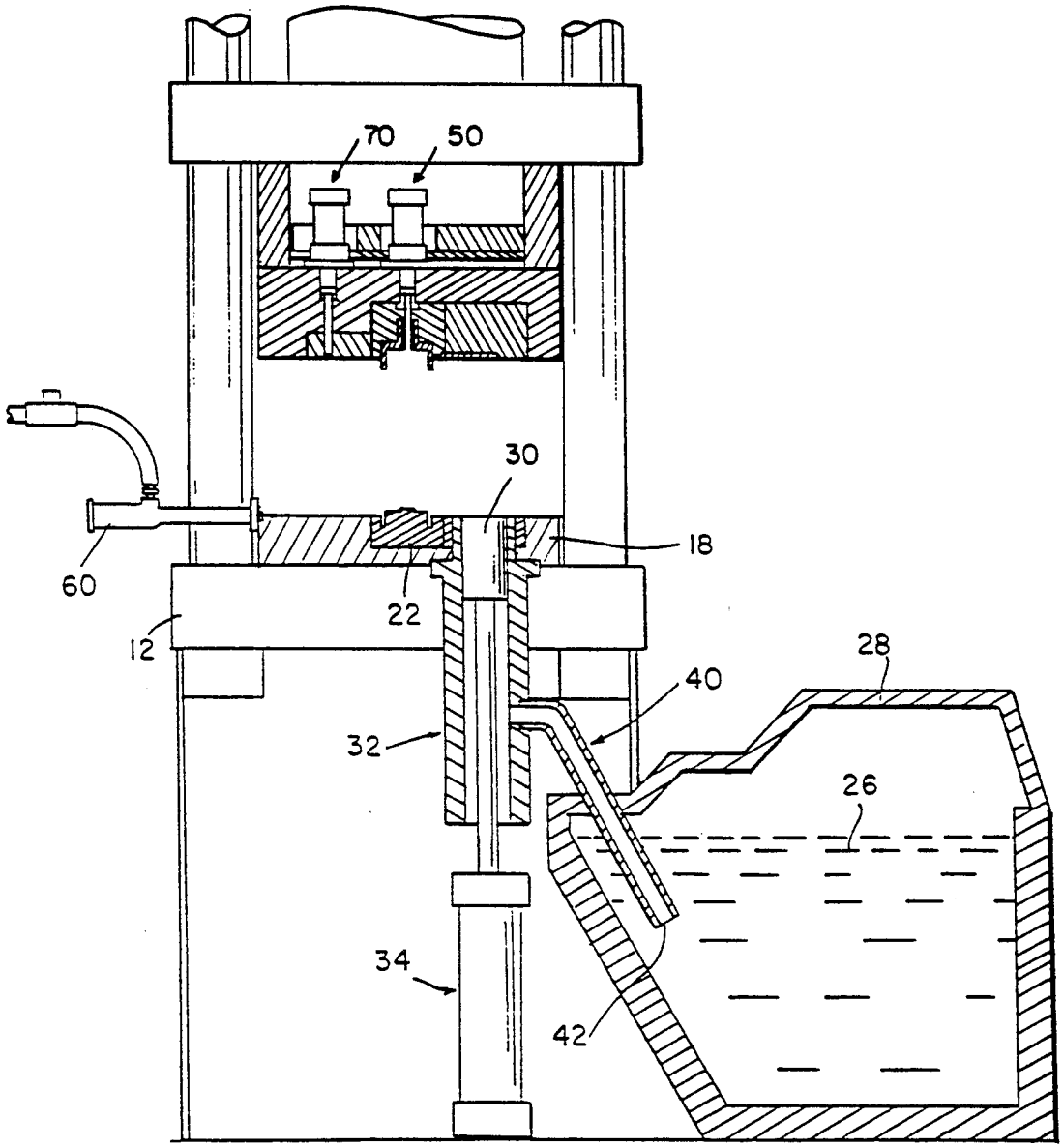
FIG. 4 shows a sectional view similar to FIG. with the upper platen in its upper position to open the die where the plunger also moves upwardly to push the casting from the cavity mold.

In FIG. 4, the upper platen 14 is raised to open the die (vertically separate the ejector die half 20 from the cover die half 18) to expose the cavity 24 and the metal casting therein. The plunger 30 is shown moved to its uppermost position which pushes the solidified casting upwardly so that it can be taken off the press. The process can then be reinitiated to move the various components back to the position shown in FIG. 1.

Figure 5:
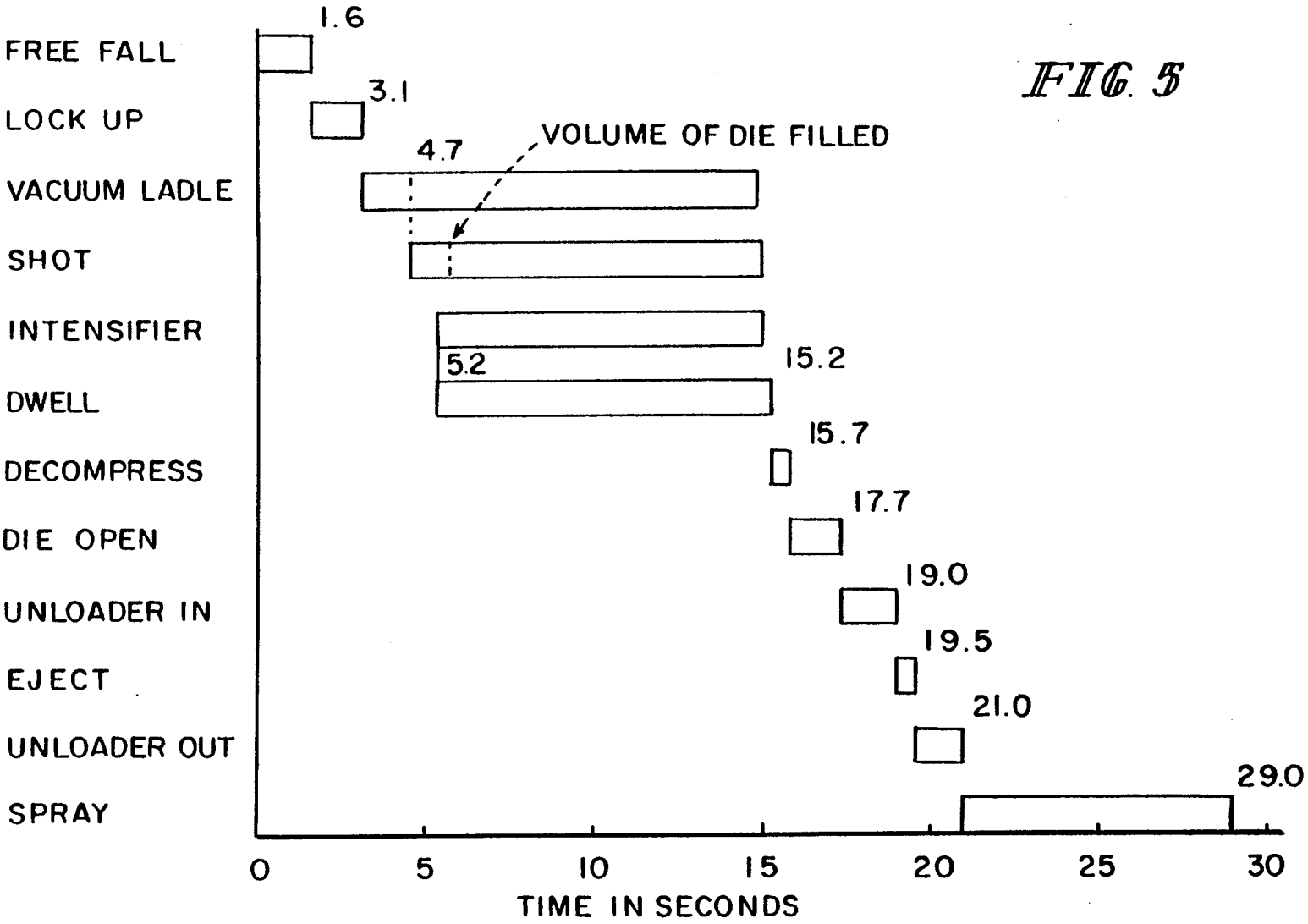
FIG. 5 is a casting cycle time line chart showing the time sequence and duration of the above-described process steps.

FIG. 5 shows a Casting Cycle Time Line to illustrate how fast the inventive process of the present invention takes place. The chart shows the various functions which occur to the left beside the vertical axis with the various steps listed in the order in which they occur. The first step, referred to as FREE FALL is the lowering of the platen 14 to its position which closes the die set 16 for LOCK UP step indicated. In a typical system, FREE FALL may take 1.6 seconds while LOCK UP may take 1.5 seconds. Thus, after 3.1 seconds, with the system sealed, the VACUUM LADLE step can begin and take place over a duration of 1.6 seconds to bring the total cycle time to 4.7 seconds. The vacuum will remain on, as indicated in the chart, until it is shut off as discussed above. The SHOT step will typically be initiated, for example, very quickly over a period of 0.5 seconds to provide a cycle time at that point, when the cavity 24 is filled, of 5.2 seconds. The INTENSIFIER step may then be initiated, for example, within 0.003 seconds of the completion of the SHOT step, and the squeeze pressure may be held by plunger for a considerable period of time as shown by the chart, for instance, to the end of the DWELL time. The INTENSIFIER step should be initiated just as the shot stroke is completed so that the flow of metal through the gate is not interrupted.

The DWELL time of 10 seconds is the time over which the molten metal solidifies to the point it can be sufficiently rigid to be removed from the cavity 24. Thereafter, other steps such as DECOMPRESSION, DIE OPEN, UNLOADER IN, EJECT, UNLOADER OUT, and SPRAY may typically take the times shown. While all of the steps from DECOMPRESSION through SPRAY are typical steps not necessarily involved in the process of the present invention, they do show how quickly a die-cast system can be cycled to start another cycle of casting molten metal. It will be appreciated that the DWELL of 10 seconds would need to be substantially increased if the molten metal were injected at temperatures considerably higher, for instance, the temperature of high temperature metal.

It has been found that squeeze die-cast parts made in accordance with the present invention and on the machinery described above with the cycle times shown in FIG. 5 and with the small feed gates, high gate velocities, low temperature metal, vacuum ladling and high squeeze pressures will produce die-cast parts having remarkably improved structural integrity and porosity characteristics. These parts, when cast from a heat treatable aluminum alloy having a freezing point of about 945° to about 1,200° F., such as a 390 aluminum alloy, can then be further improved by heat treating in accordance with T-6 heat treating process discussed above, particularly with the cool water quench which takes place quickly for instance within about 10 seconds or a similar short time which will not permit significant cooling after the long soaking at the high temperature involved in T-6 heat treating for the required period of time.

It has been found that increasing the feed gate velocity is quite important to producing castings having good structural integrity and good porosity characteristics. Essentially, with a given shot plunger 30 size and pressure and stroke speed, it has been found that making the feed gates smaller to increase the metal flow velocity through the gate improves the casting's characteristics. In fact, it has been found that, using the process features and steps of the present invention, the castings are not getting the usual shrinkage, even in the thick casting sections away from the feed gate, found in conventional die-cast parts. This unexpected and beneficial result, which may eliminate the need for the high maintenance intensification pins 52 for the thick sections away from the feed gate, is believed to derive from the unique combination of process steps, and particularly the evacuated die cavity which is accomplished in the vacuum ladling, the use of low metal temperature, the high gate velocity which is believed to create the aforementioned metal spray into the cavity and the very quick and fast action at providing the high squeeze pressures.

The novel combination of steps of the present invention works well with certain hypereutectic metal alloys such as a 390 aluminum alloy. Essentially, a hypereutectic aluminum alloy is an alloy which will hold its eutectic state longer, i.e., the state at which the metal is at the same temperature in both its liquid and solid state. At this eutectic state, when the metal is, perhaps, at or even just below the point at which it begins to solidify, the squeeze pressure provided by the plunger 30 adds even more pressure on the metal in the cavity after the metal normally should be freezing.

It is believed that the process of the present invention should improve the characteristics of most heat treatable aluminum alloys. While a 390 aluminum alloy has been discussed herein, it will be appreciated that there are other aluminum alloys which have similar characteristics. The 390 aluminum alloy, which is normally heat treated after permanent mold casting or after forging, can now be squeeze die-cast in a high volume, low cost apparatus and then heat treated in accordance with T-6 heat processes.

Other alloys, such as a 356 aluminum alloy, can similarly be improved by die-casting in accordance with the present invention and then further improved by heat treating by the T-6 process. It has been found that a 356 aluminum alloy, which has been permanent mold cast and then heat treated in accordance with the T-6 heat treating procedures will have a given yield strength well known in the trade. It has also been found that a 356 aluminum alloy cast in accordance with the die-casting process of the present invention will have even greater strength than the permanent mold cast part with the T-6 heat treating. Then, heat treating the squeeze die-cast part cast in accordance with the present invention with the T-6 heat treating process produced even greater strength results.

Figure 6:
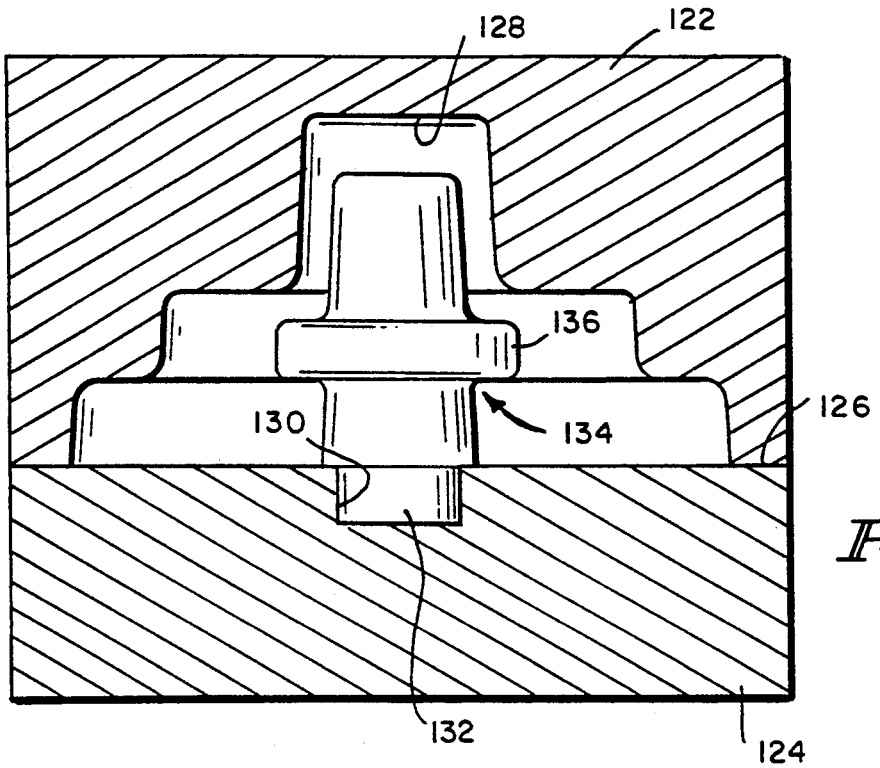
FIG. 6 is an enlarged sectional view showing a pair of cavity blocks usable in a VERTI-CAST machine and showing a complex core piece rigidly positioned in a cavity defined by the pair of cavity blocks.

Turning to FIG. 6, there is illustrated in cross-section a typical cavity block construction with a complex internal core installed. A top cavity block 122 is shown in its operative position relative to a bottom cavity block 124. Cavity blocks 122, 124 are designed to be positioned in engaging relationship to define a parting line 126. As has been previously described, the cavity blocks lie between the upper and lower die halves.

As shown, top cavity block 122 and bottom block 124 cooperate to define a cavity 128 of complex geometry. The particular geometry shown for cavity 128 is by way of example only; it will be appreciated by those of ordinary skill in the art that a wide variety of cavity shapes may be used in connection with the die-casting processes of the present invention. Molten metal is fed to cavity 128 by way of a runner system (not shown) including a metal feed gate or a vacuum gate as heretofore described with respect to the embodiments of FIGS. 1–4.

Bottom cavity block 124 is formed to include an upwardly-opening groove or notch 130. Notch 130 is designed to receive a lower portion 132 of a complex core piece 134 in tight fitting relationship.

Core piece 134 is referred to as a "complex core" because it includes protrusions 136 which complicate the process of removing core piece 134 from the die-cast part. Non-complex cores are cores which typically include tapered edges which generally converge in the direction of top cavity block 122. Such cores can readily be removed from the die-cast part after the part has hardened. On the other hand, cores having complex geometries such as core piece 134 cannot be removed once the die-cast part has hardened around protrusions 136. It will be appreciated that a complex cores of nearly an endless variety of geometries might be required for the production of various die-cast parts. Complex core 134 is shown by way of example only.

Complex core 134 is advantageously formed of a high melting point core metal, i.e., one that will melt at temperatures above 700° F. to about 925° F. Zinc alloys are particularly preferred high melting point core metals for use in accordance with the present invention. Most preferred is the zinc alloy Zamac-3, which melts at about 728° F. Another preferred alloy is Zamac-5, which melts at about 727° F. Pure zinc melts at about 780° F.

In operation of the process of the present invention to produce die-cast parts having complex internal geometries, a core piece having the desired complex geometry, such as core piece 134, is rigidly positioned in cavity 128. Cavity 128 is defined by cavity blocks 122, 124, which, during operation of the process, lie between a pair of dies (not shown) as described and illustrated in FIGS. 1–4.

Core piece 134 may be positioned in cavity 128 at room temperature. However, it is recognized that the molten metal injected into cavity 128 to form the die-cast part is likely to have a melting temperature much greater than the melting temperature of core piece 134. For example, a typical aluminum alloy used in forming a die-cast part may melt at 1,200°–1,250° F. or higher, while core piece 134 in accordance with the present invention will melt no higher than about 925° F. Thus, even though the time of contact between the molten metal and core piece 134 is very brief, it is possible that the molten metal will begin to melt even a high melting point metal core piece such as core piece 134 at the surface of the core piece, pitting the surface or otherwise adversely affecting dimensional stability.

Advantageously, then, core piece 134 might be subjected to a chilling step before it is rigidly positioned in cavity 128. Specifically, core piece 134 might be chilled to approximately −300° F. using liquid nitrogen. Molten metal contacting the surface of chilled core piece 134 will freeze, creating a skin of aluminum around core piece 134. Additional molten metal injected into cavity 128 to form the die-cast part contacts the aluminum skin, not the surface of core piece 134, thus preventing deformation of the surface of core piece 134.

Figure 7:
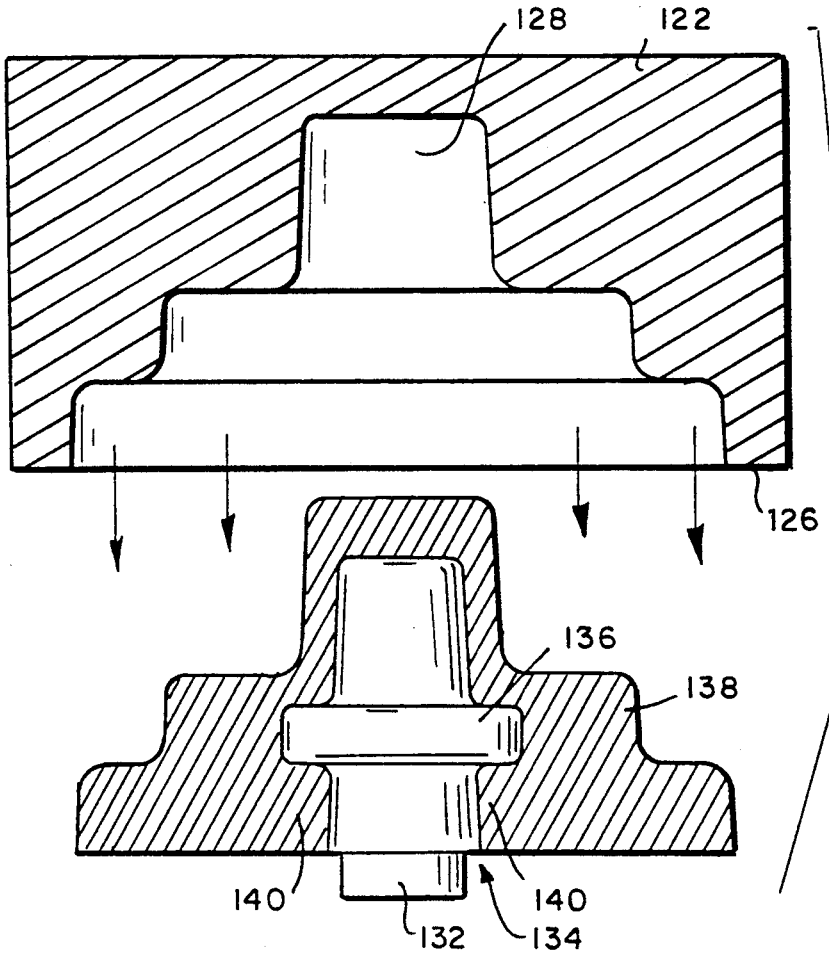
FIG. 7 is a view similar to FIG. 6 showing a die-cast part and a trapped complex core piece both removed from the cavity blocks; and, FIG. 8 is a view similar to FIGS. 6–7 showing the die-cast part with the complex core piece melted and removed to leave an internal cavity of complex geometry in the die-cast part.

The die-cast part is produced using the series of steps previously described with respect to other embodiments of the invention. After the pressurized metal in cavity 128 is allowed to solidify, the resulting die-cast part 138 is ejected from cavity 128 as illustrated in FIG. 7. At this time, core piece 134 is still embedded in die-cast part 138 and must be removed. As shown, portions 140 of die-cast part 138 trap protrusions 136, thus impeding removal of core piece 134 from die-cast part 138. Die-cast part 138 and its trapped core piece 134 are therefore subjected to processing which results in the melting of core piece 134 to leave a complex internal geometry in die-cast part 138.

Figure 8:
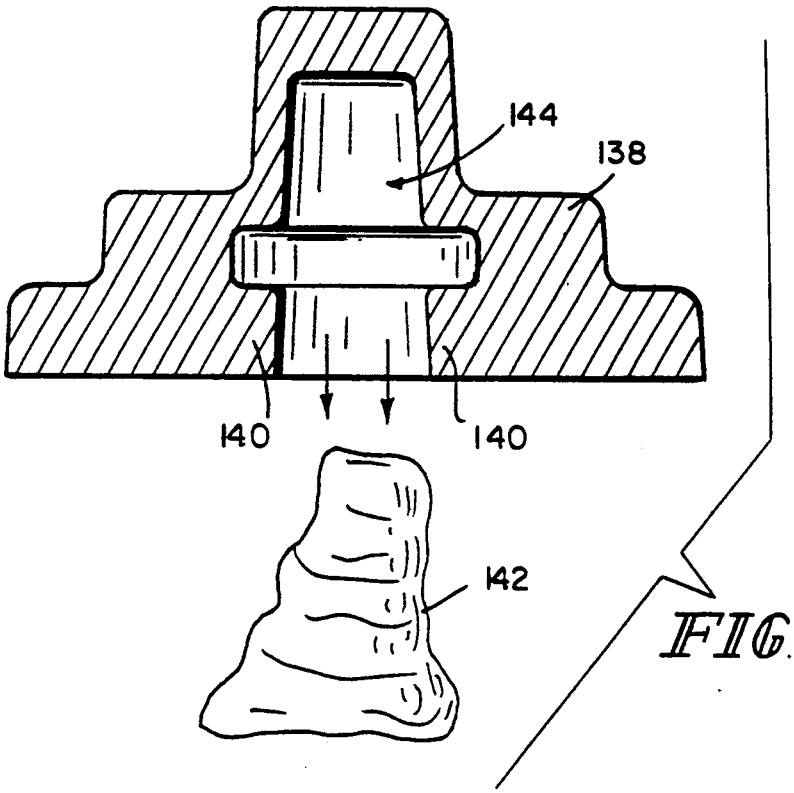

The melting procedure can include the step of subjecting the die-cast part 138 and trapped core piece 134 to T-6 heat treating. Part 138 and core piece 134 may be placed in a rack using standard heat treating techniques. As part 138 and core piece 134 reach a temperature approaching the temperature of the T-6 heat treating bath, core piece 134 will melt and separate from die-cast part 138 as a discrete mass 142 as shown in FIG. 8. An internal cavity 144 of complex geometry is thus formed in die-cast part 138.

The melting procedure may alternatively be carried out without the use of T-6 heat treating. However, extra processing may be required to maintain die-cast part 138 at its desired hardness. To maintain proper hardness, die-cast part 138, upon being ejected from cavity 128, is subjected to heat treating at a sufficient temperature and for a sufficient time to increase the hardness of the casting from its original hardness to an increased hardness about 10–15 Brinnell greater than the original hardness.

For example, a typical aluminum alloy die-cast part 138 might be heat treated at about 350° F. for about five hours. The original hardness of part 138, about 75–80 Brinnell, will be increased through use of this processing step to about 90–95 Brinnell.

Core piece 134 can then be melted out of die-cast part 138. Specifically, die-cast part 138 and trapped core piece 134 can be subjected to a temperature of about 850° F. for about one-half hour where core piece 134 is constructed from a zinc alloy such as Zamac-3. Core piece 134 will melt and separate from die-cast part 138 as a discrete mass, leaving internal cavity 144 formed in die-cast part 138. This melting step will lower the hardness of die-cast part 138 from the increased hardness of about 90–95 Brinnell back to the original, desired hardness of about 75–80 Brinnell where die-cast part 138 is formed from a typical aluminum alloy.

We claim:

1. A process for manufacture of molded metal castings in a die-casting apparatus of the type comprising at least a pair of dies forming at least one cavity therebetween having a vacuum gate and a metal feed gate and a runner communicating with the metal feed gate for delivery of molten metal into the cavity, a source of molten metal a charge sleeve communicating with said molten metal source and said runner for receiving molten metal from said source and directing it through the runner to said feed gate into said cavity, said feed gate controlling the flow of metal from said runner into said cavity, a plunger reciprocally disposed in said sleeve and means for applying pressure to said plunger to force the molten metal under pressure through said runner and metal feed gate into said cavity, a vacuum source communicating with said vacuum gate, cavity, feed gate, runner and sleeve to remove gases therefrom and with sufficient suction quickly to draw the molten metal from its source into said sleeve in a position to be driven by said plunger, the process comprising the steps of placing a core piece providing a complex core shape between said pair of dies and rigidly positioning said piece in said cavity, said core piece being formed from high melting point core metal that will melt at temperatures greater about than 700° F. and less than about 925° F., drawing the vacuum to ladle the molten metal into said sleeve in an amount of time to prevent any appreciable solidifying of the molten metal, immediately actuating said plunger as soon as a molten metal charge is ladled into said sleeve to drive molten metal through said metal feed gate to control the gate velocity into the cavity initially to fill said cavity and surround said core piece, and thereafter increasing said pressure on said plunger at least up to about 10,000 on the molten metal to force additional molten metal through said feed gate, controlling the temperature of the molten metal at less than about 100° F. above the temperature at which the metal begins to solidify, selecting the metal feed gate to have a cross-sectional area such that with the plunger actuation molten metal is fed at a velocity of about 40 to about 150 feet/second into said cavity during the cavity filling step and such that molten metal flows through said feed gate during the pressure increasing step, removing the resulting casting from the cavity after allowing the pressurized metal in the cavity to solidify, and melting the core piece out of the resulting casting to leave a complex core shape therein.

2. The process of claim 1 further comprising the step of chilling the core piece to a temperature sufficiently low to enhance its dimensional and positional stability in the cavity.

3. The process of claim 1, wherein the melting step includes the step of subjecting the casting to T-6 heat treating.

4. The process of claim 1, further comprising the step of heat treating the casting at a sufficient temperature and for a sufficient time to increase the hardness of the casting from an original hardness to an increased hardness about 10–15 Brinnell greater than the original hardness, and wherein the melting step is carried out at a temperature sufficient to return the casting hardness from the increased hardness to about the original hardness.

5. The process of claim i, wherein the high melting point core metal comprises a zinc alloy having a melting temperature from greater than 700° F. to about 750° F.

6. The process of claim 1 wherein the die-casting apparatus is a vertical die-casting machine.

7. The process of claim 1 wherein the feed gate is dimensioned to have a cross-sectional area of less than about 0.2 in.$^2$.

8. A process for manufacture of molded metal castings in a die-casting apparatus of the type comprising at least a pair of dies forming at least one cavity therebetween having a vacuum gate and a metal feed gate and a runner communicating with the metal feed gate for delivery of molten metal into the cavity, a source of molten metal, a charge sleeve communicating with said molten metal source and said runner for receiving molten metal from said source and directing it through the runner to said feed gate into said cavity, said feed gate controlling the flow of metal from said runner into said cavity, a plunger reciprocally disposed in said sleeve and means for applying pressure to said plunger to force the molten metal under pressure through said runner and metal feed gate into said cavity, a vacuum source communicating with said vacuum gate, cavity, feed gate, runner and sleeve to remove gases therefrom and with sufficient suction quickly to draw the molten metal from its source into said sleeve in a position to be driven by said plunger, the process comprising the steps of placing a core piece providing a complex core shape between said pair of dies and rigidly positioning said piece in said cavity, said core piece being formed from high melting point core metal that will melt at temperatures greater about than 700° F. and less than about 925° F., drawing the vacuum to ladle the molten metal into said sleeve in an amount of time to prevent any appreciable solidifying of the molten metal, immediately actuating said plunger as soon as a molten metal charge is ladled into said sleeve to drive molten metal through said metal feed gate to control the gate velocity into the cavity initially to fill said cavity and surround said core piece, and thereafter increasing said pressure on said plunger at least up to about 10,000 on the molten metal to force additional molten metal through said feed gate, removing the resulting casting from the cavity after allowing the pressurized metal in the cavity to solidify, and melting the core piece out of the resulting casting to leave a complex core shape therein.

9. The process of claim 8 further comprising the step of chilling the core piece to a temperature sufficiently low to enhance its dimensional and positional stability in the cavity.

10. The process of claim 8, wherein the melting step includes the step of subjecting the casting to T-6 heat treating.

11. The process of claim 8, further comprising the step of heat treating the casting at a sufficient temperature and for a sufficient time to increase the hardness of the casting from an original hardness to an increased hardness about 10–15 Brinnell greater than the original hardness, and wherein the melting step is carried out at a temperature sufficient to return the casting hardness from the increased hardness to about the original hardness.

12. The process of claim 8, wherein the high melting point core metal comprises a zinc alloy having a melting temperature from greater than 700° F. to about 750° F.

13. The process of claim 8 wherein the die-casting apparatus is a vertical die-casting machine.

14. A process for die-casting aluminum alloy metal in a die-casting apparatus of the type comprising at least a pair of dies forming at least one cavity therebetween having a small vacuum gate and a metal feed gate and a runner communicating with the metal feed gate for delivery of molten metal into the cavity, a source of molten metal, a charge sleeve communicating with said runner for receiving molten metal from said source and directing it through the runner to said feed gate into said cavity, said feed gate controlling the flow of metal from said runner into said cavity, a plunger reciprocally disposed in said sleeve and means for applying pressure to said plunger to force the molten metal under pressure through said runner and metal feed gate into said cavity, a vacuum source and means for connecting said source to said vacuum gate, cavity, runner and sleeve to remove gases therefrom and with sufficient suction quickly to draw the molten metal from its source through a transfer tube into said sleeve in a position to be driven by said plunger, the process comprising the steps of placing a core piece providing a complex core shape between said pair of dies and rigidly positioning said piece in said cavity, said core piece being formed from high melting point core metal that will melt at temperatures greater about than 700° F. and less than about 925° F., drawing the vacuum and quickly ladling the molten metal into said sleeve in a short amount of time to prevent any appreciable solidifying of the molten metal, immediately driving said plunger at high speed as soon as a full metal charge is ladled into said sleeve to drive molten metal through said metal feed gate into the cavity initially to fill said cavity and surround said core piece, and thereafter increasing the pressure on the molten metal to about 10,000 to about 20,000 psi to force additional molten metal through said feed gate as the metal solidifies and until the feed gate freezes closed, controlling the temperature of the molten metal at less than about 100° F. above the temperature at which the metal begins to solidify, selecting the metal feed gate to have a cross-sectional area such that with the plunger actuation molten metal is fed at a velocity of about 40 to about 150 feet/second into said cavity during the cavity filling step and such that molten metal flows through said feed gate during the pressure increasing step, permitting the metal to dwell in said cavity to solidify, removing the resulting casting from the cavity after allowing the pressurized metal in the cavity to solidify, and melting the core piece out of the resulting casting to leave a complex core shape therein.

15. The process of claim 14 further comprising the step of chilling the core piece to a temperature sufficiently low to enhance its dimensional and positional stability in the cavity.

16. The process of claim 14, wherein the melting step includes the step of subjecting the casting to T-6 heat treating.

17. The process of claim 14, further comprising the step of heat treating the casting at a sufficient temperature and for a sufficient time to increase the hardness of the casting from an original hardness to an increased hardness about 10–15 Brinnell greater than the original hardness, and wherein the melting step is carried out at a temperature sufficient to return the casting hardness from the increased hardness to about the original hardness.

18. The process of claim 14, wherein the high melting point core metal comprises a zinc alloy having a melting temperature from greater than 700° F. to about 750° F.

19. The process of claim 14 wherein the die-casting apparatus is a vertical die-casting machine.

20. The process of claim 14 wherein the feed gate is dimensioned to have a cross-sectional area of less than about 0.2 in.$^2$.

* * * * *